US012520960B2

(12) United States Patent
Lin

(10) Patent No.: US 12,520,960 B2
(45) Date of Patent: Jan. 13, 2026

(54) TREE TOPPER

(71) Applicant: Fangfang Lin, Zhejiang Province (CN)

(72) Inventor: Fangfang Lin, Zhejiang Province (CN)

( * ) Notice: Subject to any disclaimer, the term of this patent is extended or adjusted under 35 U.S.C. 154(b) by 103 days.

(21) Appl. No.: 18/392,636

(22) Filed: Dec. 21, 2023

(65) Prior Publication Data

US 2025/0176749 A1 Jun. 5, 2025

(30) Foreign Application Priority Data

Dec. 4, 2023 (CN) ..... 202323294532.4

(51) Int. Cl.
*A47G 33/08* (2006.01)
*A47F 5/025* (2006.01)

(52) U.S. Cl.
CPC ..... *A47G 33/0809* (2013.01); *A47F 5/025* (2013.01); *A47G 33/0818* (2013.01); *A47G 2033/0827* (2013.01); *A47G 2033/089* (2013.01)

(58) Field of Classification Search
CPC ..... A47G 33/0809; A47G 33/0818; A47G 2033/0827; A47G 2033/089; A47F 5/025
See application file for complete search history.

(56) References Cited

U.S. PATENT DOCUMENTS 1,612,362 A * 12/1926 Decker ..... G09F 13/00 362/232
2,005,293 A * 6/1935 Harris ..... A47G 33/126 248/522
2,922,330 A * 1/1960 Chuy ..... A47G 33/0809 40/473
5,618,103 A * 4/1997 Fussell ..... F21V 23/00 362/396
5,878,671 A * 3/1999 Kehl ..... A47G 23/08 211/163
2002/0127948 A1* 9/2002 Tang ..... A47G 33/00 446/330
2016/0367059 A1* 12/2016 Embler ..... F21V 7/0025

FOREIGN PATENT DOCUMENTS

DE 202010016963 U1 * 4/2011 ..... A47F 11/00
DE 202016104235 U1 * 1/2017 ..... A47F 11/06
KR 20090006762 U * 7/2009 ..... A47F 5/025
KR 20120031767 A * 4/2012 ..... A47F 5/025

* cited by examiner

*Primary Examiner* — Alexander K Garlen

(57) ABSTRACT

An illuminating display device, including: a rotator, a drive, a mounting component and a lighting component, the rotator and the drive are all mounted to the mounting component, the lighting component includes a decoration and a light source, the light source is set opposite to the decoration to brighten the decoration, the decoration is fixedly connected to the rotator, the rotator is rotatably connected to the mounting component, and the drive is connected to the rotator to drive the rotator to rotate so as to rotate the decoration.

8 Claims, 7 Drawing Sheets

TREE TOPPER

TECHNICAL FIELD

The present invention relates to the technical field of lighting, and in particular, to an illuminating display device.

BACKGROUND illuminating display device is not only an indoor lighting device, but also one of the important indoor decorative elements, illuminating display device not only serves the function of creating light and shadow effects, but also serves the function of creating an atmosphere, and the illuminating display device is often used in combination with other decorations to perform a decorative function, for example, the illuminating display device for Christmas and other festivals, which has a very important role in creating a festive atmosphere and is often installed on the Christmas tree for creating a Christmas atmosphere together with the Christmas tree, however, it is difficult for current illuminating display devices to create light and shadow effects changing dynamically.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, an illuminating display device is provided, comprising: a rotator, a drive, a mounting component and a lighting component, the rotator and the drive are all mounted to the mounting component, the lighting component comprises a decoration and a light source, the light source is set opposite to the decoration to brighten the decoration, the decoration is fixedly connected to the rotator, the rotator is rotatably connected to the mounting component, and the drive is connected to the rotator to drive the rotator to rotate so as to rotate the decoration.

The above aspects or examples and advantages, as well as other aspects or examples and advantages, will become apparent from the ensuing description and accompanying drawings.

BRIEF DESCRIPTION OF THE DRAWINGS

The drawings of the specification that form a part of the present application, are used to provide a further understanding of present the invention. Schematic embodiments and their descriptions of the present invention are used to explain the invention and do not constitute an improper limitation of the present invention. In the drawings.

Figure 1:
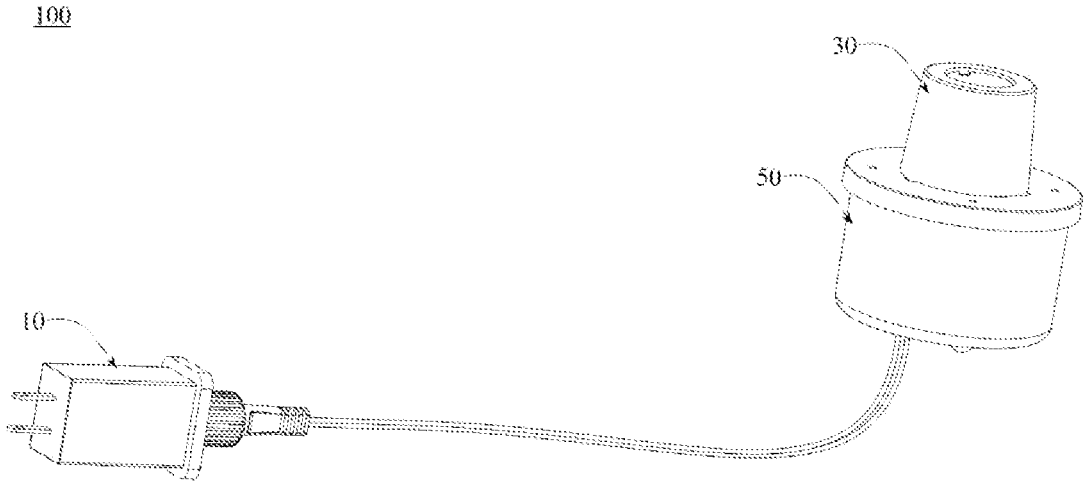
FIG. 1 shows a schematic diagram of a structure of an illuminating display device without a decoration according to an embodiment of the present application.

Description of reference signs: 100—illuminating display device; 10—power; 101—plug; 102—first conductor; 20—drive; 201—motor; 202—first gear; 30—rotator; 301—boss; 302—flange; 303—buckle; 304—first annular wall; 305—first annular protrusion; 306—second gear; 307—first opening; 308—second opening; 309—clamping opening; 310—mounting hole; 311—first fastener; 312—first cavity; 313—mounting base; 314—transmission member; 315—convex block; 40—lighting component; 401—light source; 402—first base; 403—decoration; 404—second annular protrusion; 50—mounting component; 501—housing; 502—second base; 503—second fastener; 504—third fastener; 505—fourth fastener; 506—speaker hole; 507—support; 508—second annular wall; 509—first threaded hole; 510—first slot; 511—first bearing; 512—second cavity; 60—controller; 601—first circuit board; 602—second conductor; and 603—third conductor.

DETAILED DESCRIPTION OF THE EMBODIMENTS

The present invention will be described in detail below with reference to the drawings and in combination with embodiments. Various examples are provided by way of interpretation of the present invention rather than limiting the present invention. In fact, those skilled in the art will know that modifications and variations can be made to the present invention without departing from the scope or spirit of the present invention. For example, features shown or described as part of one embodiment may be used in another embodiment to generate another embodiment. It is therefore desirable that the present invention includes such modifications and variations that fall within the scope of the appended claims and their equivalents.

In the description of the present invention, the terms "longitudinal", "latitudinal", "up", "down", "front", "rear", "left", "right", "vertical", "horizontal", "top", "bottom", etc. indicate the orientation or positional relationship based on the drawings, which is only for the convenience of describing the present invention rather than requiring the present invention to be constructed and operated in a specific orientation, Therefore, it cannot be understood as a limitation of the present invention. The terms "connected", "connection" and "configure" used in the present invention should be understood in a broad sense, for example, it can be a fixed connection or a detachable connection; it can be a direct connection or an indirect connection through an intermediate part; it can be a wired electrical connection, a radio connection, or a wireless communication signal connection. For those skilled in the art, the specific meaning of the above terms can be understood according to the specific situation.

One or more examples of the present invention are shown in the drawings. The detailed description uses numerals and letter markers to refer to features in the drawings. Similar or like numerals in the drawings and descriptions have been used to refer to similar or like parts of the present invention. As used herein, the terms "first", "second", and "third" are used interchangeably to distinguish one component from another and are not intended to indicate the location or importance of individual components.

Figure 2:
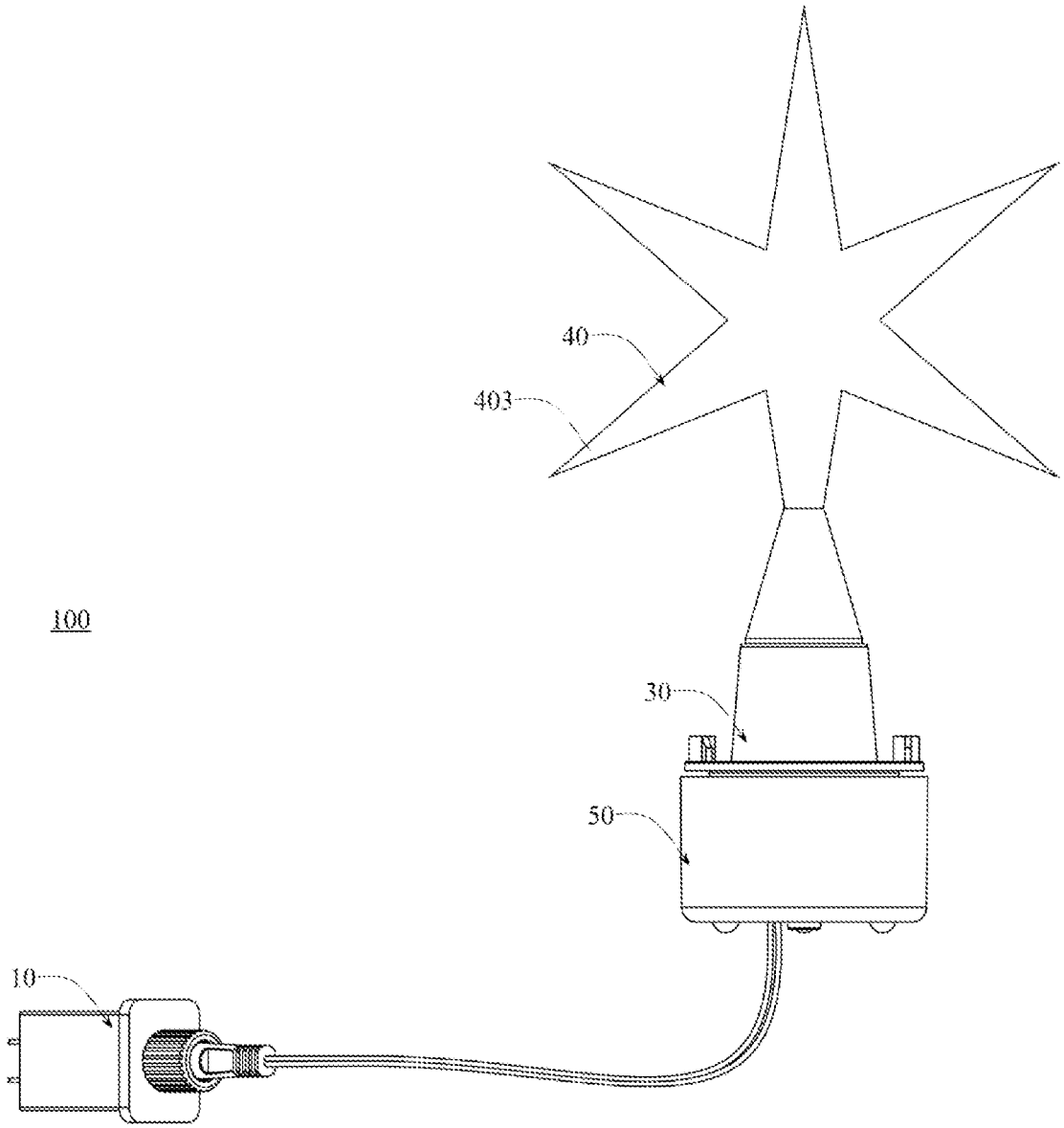
FIG. 2 shows a schematic diagram of an overall structure of an illuminating display device according to an embodiment of the present application.
Figure 3:
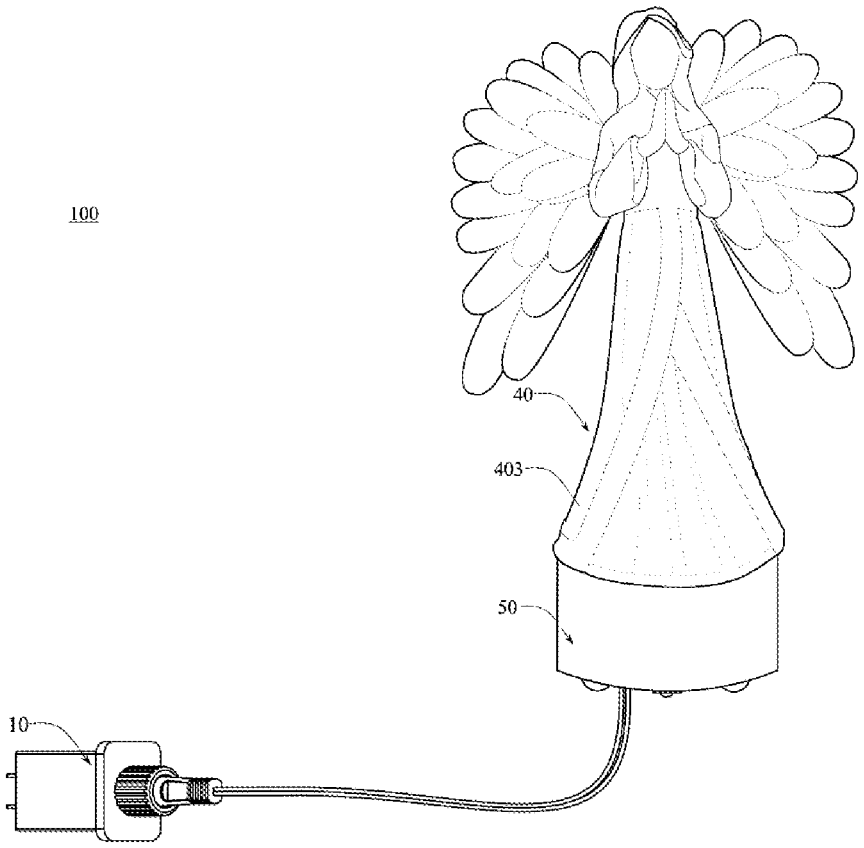
FIG. 3 shows a schematic diagram of an overall structure of an illuminating display device according to another embodiment of the present application.
Figure 4:
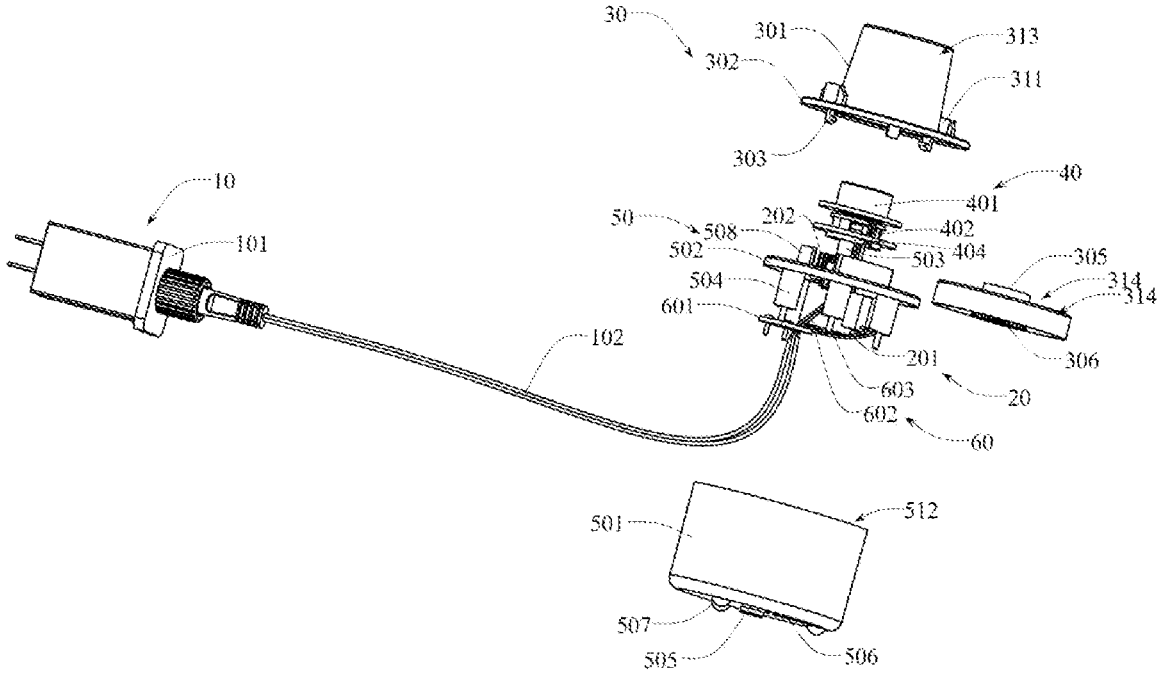
FIG. 4 shows a schematic diagram of an exploded structure of an illuminating display device according to an embodiment of the present application.
Figure 5:
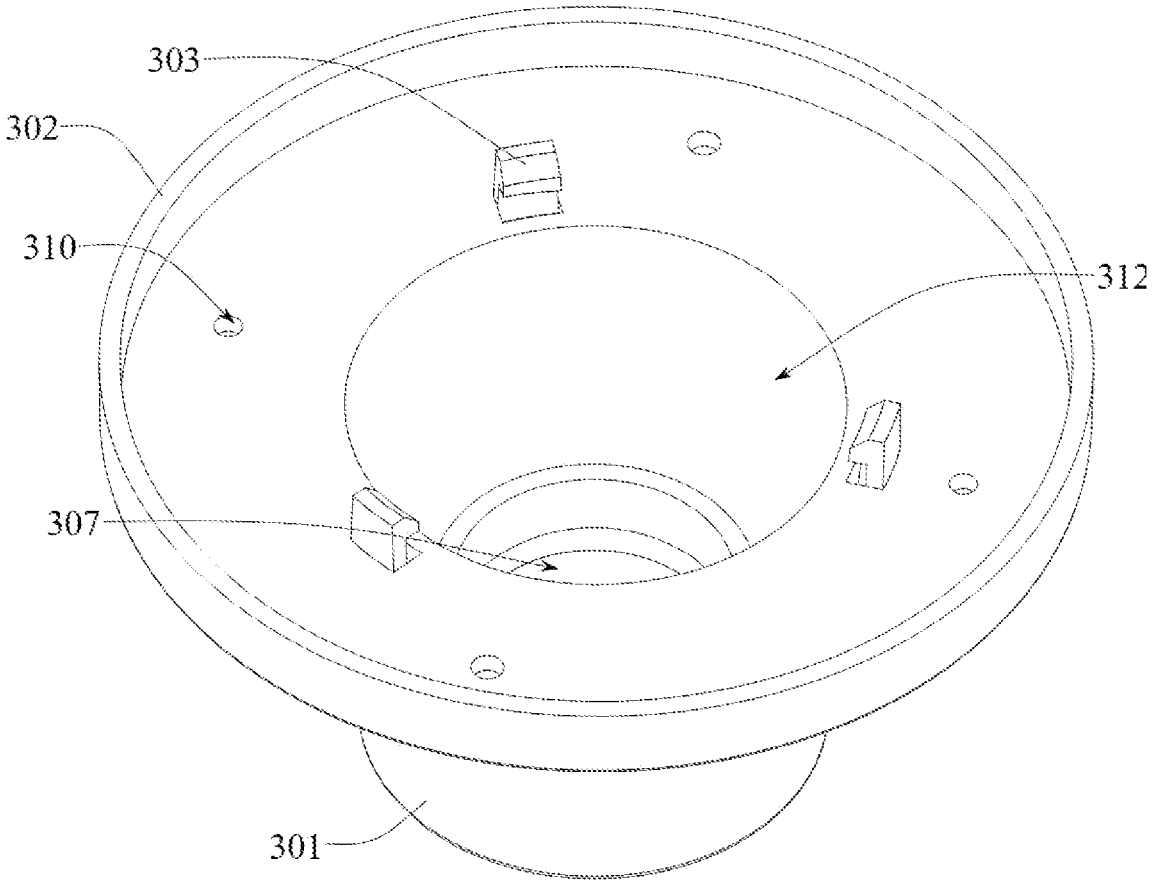
FIG. 5 shows a schematic structure of a mounting base according to an embodiment of the present application.
Figure 6:
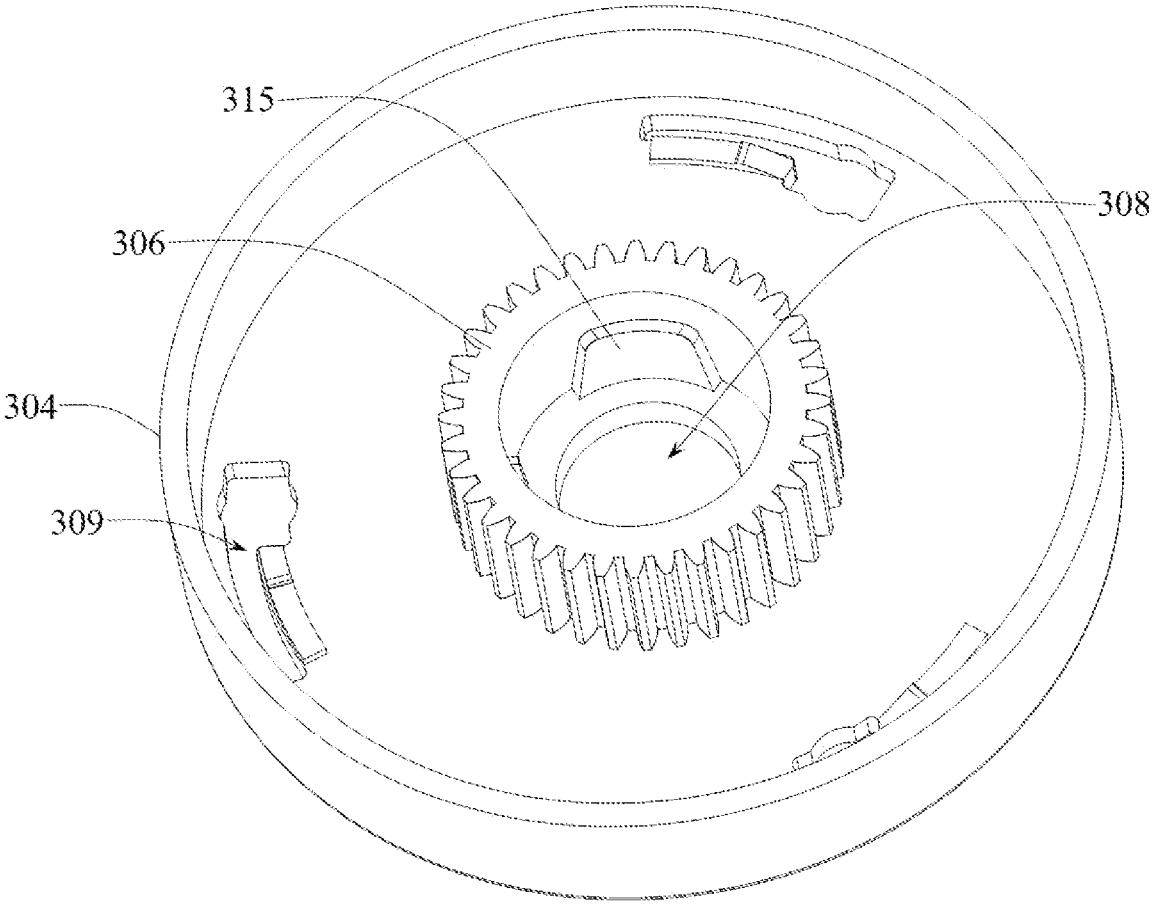
FIG. 6 shows a schematic structure of a transmission member according to an embodiment of the present application.
Figure 7:
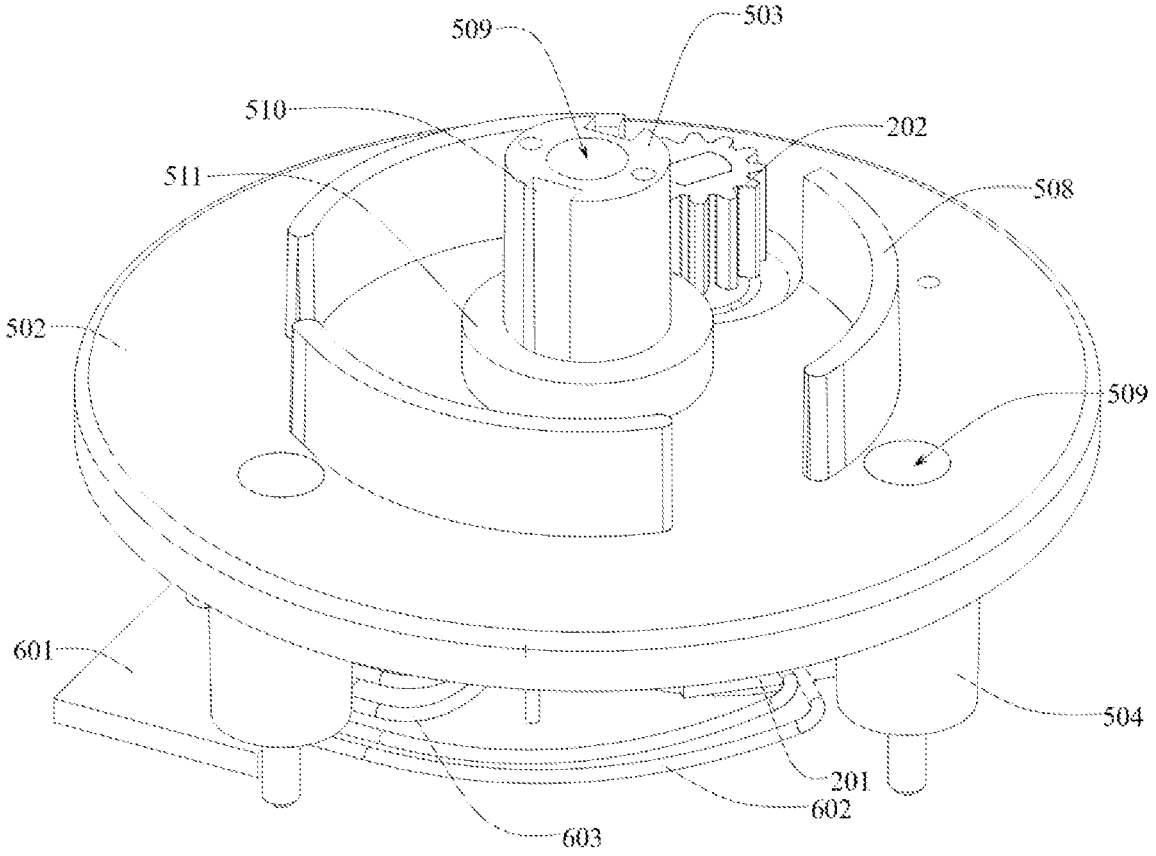
FIG. 7 shows a schematic structural diagram of a mounting component without a housing according to an embodiment of the present application.

Referring to FIGS. 1 to 4, the present application provides an illuminating display device 100 comprising a rotator 30, a drive 20, a mounting component 50, and a lighting component 40, the rotator 30 and the drive 20 are both mounted to the mounting component 50, the lighting component 40 comprises a decoration 403 and a light source 401, the light source 401 is set opposite to the decoration 403 to brighten the decoration 403, the decoration 403 is fixedly connected to the rotator 30, the rotator 30 is rotatably connected to the mounting component 50, and the drive 20 is connected to the rotator 30 to drive the rotator 30 to rotate so as to rotate the decoration 403.

In this embodiment, the illuminating display device 100 further comprises a power 10, the power 10 comprises a plug 101 and a first conductor 102, the plug 101 is connectable to an external socket, the plug 101 is electrically connected to the drive 20 and the lighting component 40 via the first conductor 102 to supply power to the drive 20 and the lighting component 40; it is understandable that, in some embodiments, the power 10 comprises a removable power such as a battery, which is not required to be provided with the plug 101, and the battery directly supplies power to the drive 20 and the lighting component 40 through the first conductor 102.

In this embodiment, the drive 20 includes a motor 201 and a first gear 202, the rotator 30 is provided with a second gear 306, the second gear 306 is fixedly connected to the rotator 30, and the motor 201 drives the first gear 202 to rotate in order to drive the second gear 306 to rotate so as to drive the rotator 30 to rotate.

In this embodiment, the rotator 30 further comprises a mounting base 313 and a transmission member 314, the decoration 403 is mounted on the mounting base 313, the mounting base 313 is fixedly connected to the transmission member 314, the second gear 306 is fixedly connected to the transmission member 314, the second gear 306 rotates to drive the transmission member 314 to rotate, the transmission member 314 rotates to drive the mounting base 313 to rotate so as to drive the decoration 403 to rotate.

In this embodiment, the mounting base 313 further comprises a boss 301 and a flange 302, the flange 302 is fixedly connected to the transmission member 314, and the boss 301 is fixedly connected to the decoration 403, so that the height at which the decoration 403 is located is capable of being increased due to the decoration 403 being fixedly connected to the boss 301, so as to meet the need for placing the decoration 403 in a higher position; it is understandable that, in some embodiments, the decoration 403 can also be fixedly connected to the flange 302, and the location where the decoration 403 is mounted can be determined based on the shape, size, and mounting means of the decoration 403.

In this embodiment, the second gear 306 and the transmission member 314 are formed integrally; it is understandable that, in some embodiments, the second gear 306 may also be fixedly connected to the transmission member 314 by other means such as, for example, welding, adhering, riveting, threading, and the like, but is not limited thereto.

In this embodiment, the mounting base 313 is set opposite to the transmission member 314, the mounting base 313 comprises a first screw hole (not shown in the drawings), and the transmission member 314 is provided with a second screw hole (not shown in the drawings) at a corresponding position, and the mounting base 313 is fixedly connected to the transmission member 314 by means of screws (not shown in the drawings) passing through the first screw hole and the second screw hole.

In another embodiment, the mounting base 313 comprises a buckle 303, the buckle 303 is set on the side of the flange 302, which is toward the transmission member 314, the transmission member 314 is provided with a clamping opening 309 at a position corresponding to the buckle 303, and the mounting base 313 is clamped to the clamping opening 309 of the transmission member 314 by the buckle 303; it is understandable that, in some embodiments, the mounting base 313 can also be fixedly connected to the transmission member 314 by, for example, a welding, adhering, riveting, screwing, and other means for being fixedly connected to the transmission member 314, but is not limited thereto.

In this embodiment, the flange 302 is also provided with a mounting hole 310, and the decoration 403 is mountably connected to the mounting base 313 through the mounting hole 310; in this way, the user is capable of mounting different decoration 403 according to the user's personal needs.

Optionally, the flange 302 is also provided with a first fastener 311, and the decoration 403 is mountably and removably connected to the mounting base 313 via the first fastener 311; in this way, the user is capable of mounting different decoration 403 more flexibly according to the personal needs as well as the mounting needs of the decoration 403.

Optionally, the first fastener 311 is a threaded seat.

In this embodiment, the transmitting member 314 is set opposite to the mounting component 50, the transmitting member 314 further comprises a first annular wall 304, the first annular wall 304 is set at the periphery of the transmitting member 314, and the mounting component 50 comprises a second base 502, a surface facing the transmitting member 314 on one side of the second base 502 is provided with a second annular wall 508 corresponding to the first annular wall 304, The first annular wall 304 is slidably connected to the second annular wall 508 to make the rotator 30 be rotatably connected to the mounting component 50.

In this embodiment, the rotation center of the second gear 306 is concentric with the rotation center of the transmission member 314, and the mounting component 50 further comprises a second fastener 503 corresponding to the rotation center of the second gear 306 and a first bearing 511 set around the periphery of the second fastener 503, the first bearing 511 is provided close to a side surface of the second base 502, which is toward the transmission member 314, an inner wall of the second gear 306 encloses the second fastener 503 and the first bearing 511, and the inner wall of the second gear 306 is slidably connected to the first bearing 511 to make the second gear 306 rotatable about the second fastener 503 and thereby make the rotator 30 be rotatably connected to the mounting component 50.

In this embodiment, the second fastener 503 is cylindrical.

Optionally, the transmission member 314 comprises a second opening 308, the inner wall of the second opening 308 has a convex block 315, the convex block 315 is located on a side of the first bearing 511, which is located away from the second base 502, and the convex block 315 is disposed on the inner wall of the second opening 308, and the first bearing 511 is located between the convex block 315 and the second base 502 so that the first bearing 511 is stuck to the surface of the second base 502 via the convex block 315 when mounting the transmission member 314 on the second base 502.

Optionally, the light source 401 is an LED light bulb, and it is understandable that, in some embodiments, the light source 401 may also be of other types such as a filament and the like.

In this embodiment, the decoration 403 is transparent or translucent, and the decoration 403 is in the shape of a star such as a five-pointed star, a six-pointed star, and the like, but is not limited thereto; it is understandable that, in some embodiments, the decoration 403 can also be in the shape of other shapes such as an angel shape, a mushroom shape, and the like.

In this embodiment, the light source 401 is fixedly connected to the mounting component 50, the mounting base 313 comprises a first opening 307, one side of the first opening 307 is opposite to the decorative member 403, the other side of the first opening 307 is opposite to the light source 401, and the light from the light source 401 travels through the first opening 307 to brighten the decoration 403.

It is understandable that, in some embodiments, the light source 401 can also be mounted on the decoration 403, so that the light source 401 can rotate along with the decoration 403 to enhance the light and shadow effects changing dynamically.

In this embodiment, the mounting base 313 further comprises a first cavity 312, the first opening 307 is communicated with the first cavity 312, and the light source 401 is contained within the first cavity 312.

In this embodiment, the lighting component 40 further comprises a first base 402, the first base 402 is fixedly connected to the second fastener 503, the first base 402 is contained in the first cavity 312, the light source 401 is provided between the first base 402 and the first opening 307, the first base 402 is provided between the light source 401 and the second fastener 503, the light source 401 is fixedly connected to the first base 402, and the first base 402 is fixedly connected to the second fastener 503.

In this embodiment, the transmission member 314 is provided with a first annular protrusion 305 on the side facing the mounting base 313, the first base 402 is provided with a second annular protrusion 404 on the side facing the transmission member 314, the first annular protrusion 305 encloses the outer side of the second annular protrusion 404 to limit the position of the first base 402, the second fastener 503 extends from the side surface of the second base 502, which faces the transmission member 314, through a hole formed by the inner face of the second gear 306, protrudes from the first annular protrusion 305, and against a side surface of the first base 402, which is toward the second fastener 503, the side surface of the first base 402, which is toward the second fastener 503, is provided with a second threaded hole corresponding to a position of the second fastener 503, the second fastener 503 is provided with a first threaded hole 509 corresponding to a position of the second threaded hole, and the first base 402 is fixedly connected to the second fastener 503 by screws.

In this embodiment, the mounting component 50 further comprises a housing 501, the housing 501 comprises a second cavity 512 and a speaker hole 506, the speaker hole 506 is provided on the bottom surface of the housing 501, the speaker hole 506 communicates with the second cavity 512, and a speaker is provided at a position corresponding to the speaker hole 506 within the second cavity 512; in this way, as a result of providing the speakers and the speaker hole 506, the illuminating display device 100 is capable of creating a lighting and shadow effect and at the same time creating a musical atmosphere. The technical features of the above embodiments can be arbitrarily combined. To make the description concise, not all possible combinations of the technical features of the above embodiments have been described. However, as long as there is no contradiction in the combination of these technical features, it should be considered as the scope of the description.

In this embodiment, the second base 502 is disposed between the transmission member 314 and the housing 501, third fasteners 504 is disposed on the side surface of the second base 502, which is toward the housing 501, the third fastener 504 is specifically a threaded base, and another threaded base is disposed on the housing 501 at a position corresponding to the third fasteners 504, and the second base 502 is fixed to the second cavity 512 of the housing 501 by screws.

The side surface of the housing 501 on which the speaker hole 506 is located further comprises a fourth fastener 505 and a support 507, the fourth fastener 505 is specifically a boss 301 protruding from a surface, and the boss 301 is provided with an plug-in socket in the middle of the boss 301, so that when the illuminating display device 100 is used to be plugged into an external object, such as a Christmas tree, the illuminating display device 100 is connected to the external object through the plug-in socket, and when the illuminating display device 100 is used to be placed on a flat surface for use, the illuminating display device 100 is supported on the external flat surface by the support 507 and the boss 301.

The illuminating display device 100 further comprises a controller 60, the controller 60 comprises a first circuit board 601, a second conductor 602, and a third conductor 603, the first circuit board 601 is provided within a second cavity 512 of the housing 501, the first circuit board 601 is electrically connected to a motor 201 via the second conductor 602 for controlling the motor 201 while powering the motor 201, the first circuit board 601 is electrically connected to a light source 401 via the third conductor 603 for controlling the light source 401 to emit light while powering it, the first circuit board 601 is also electrically connected to the speaker for controlling the speaker to make sound while powering the speaker, and the second fastener 503 is provided with a first slot 510 extending from the first base 402 to the second base 502 for containing the third conductor 603 so as to make it easy to route the third conductor 603.

The above-described illuminating display device 100, by providing a decoration 403 capable of rotating with the rotator 30 and a light source 401 capable of brightening the decoration 403 which is fixed, is capable of providing different light and shadow effects by rotating the decoration 403 to a different position and brightening different positions of the decoration 403 by the light source 401 to cause different reflections of the light, so as to create the light and shadow effects changing dynamically.

The above embodiments only described several embodiments of the present invention, and the description is relatively specific and detailed, but it cannot be understood as a limitation to the scope of the present invention patent. It should be noted that for a person of ordinary skill in the art, a number of variations and improvements can be made without departing from the conception of the present invention, and these variations and improvements fall within the scope of protection of the present invention. Therefore, the scope of protection of the present invention patent shall be subject to the appended claims.

What is claimed is:

1. An illuminating display device, comprising:

a rotator, a drive, a mounting component, and a lighting component, wherein the rotator and the drive are all mounted to the mounting component, the lighting component comprises a decoration and a light source, the light source is set opposite to the decoration to brighten the decoration, the decoration is fixedly connected to the rotator, the rotator is rotatably connected to the mounting component, and the drive is connected to the rotator to drive the rotator to rotate so as to rotate the decoration;

wherein the drive comprises a motor and a first gear, the rotator is provided with a second gear, the second gear is fixedly connected to the rotator, and the motor drives the first gear to rotate in order to drive the second gear to rotate so as to drive the rotator to rotate;

wherein the rotator further comprises a mounting base and a transmission member, the decoration is mounted on the mounting base, the mounting base is fixedly connected to the transmission member, the second gear is fixedly connected to the transmission member, the second gear rotates to drive the transmission member to rotate, the transmission member rotates to drive the mounting base to rotate so as to drive the decoration to rotate;

wherein the rotation center of the second gear is concentric with the rotation center of the transmission member, and the mounting component further comprises a second fastener corresponding to the rotation center of the second gear and a first bearing set around the periphery of the second fastener, an inner wall of the second gear encloses the second fastener and the first bearing, and the inner wall of the second gear is slidably connected to the first bearing to make the second gear rotatable about the second fastener and thereby make the rotator be rotatably connected to the mounting component.

2. The illuminating display device according to claim 1, wherein the second gear and the transmission member are formed integrally.

3. The illuminating display device according to claim 1, wherein the mounting base is set opposite to the transmission member, the mounting base comprises a buckle, the transmission member is provided with a clamping opening at a position corresponding to the buckle, and the mounting base is clamped to the clamping opening of the transmission member by the buckle.

4. The illuminating display device according to claim 1, wherein the transmission member is set opposite to the mounting component, the transmission member comprises a first annular wall, the mounting component is provided with a second annular wall disposed corresponding to the first annular wall, the first annular wall is slidably connected to the second annular wall to make the rotator be rotatably connected to the mounting component.

5. The illuminating display device according to claim 1, wherein the light source is fixedly connected to the mounting component, the mounting base comprises a first opening, one side of the first opening is opposite to the decoration, the other side of the first opening is opposite to the light source, and light from the light source travels through the first opening to brighten the decoration.

6. The illuminating display device according to claim 5, wherein the mounting base further comprises a first cavity, the first opening is communicated to the first cavity, and the light source is contained in the first cavity.

7. The illuminating display device according to claim 1, wherein the mounting component comprises a second cavity and a speaker hole, the speaker hole is disposed on one side of the mounting component, the speaker hole is communicated with the cavity, and a speaker is disposed in the cavity at a position corresponding to the speaker hole.

8. An illuminating display device, comprising:

a rotator, a drive, a mounting component, and a lighting component, wherein the rotator and the drive are all mounted to the mounting component, the lighting component comprises a decoration and a light source, the light source is set opposite to the decoration to brighten the decoration, the decoration is fixedly connected to the rotator, the rotator is rotatably connected to the mounting component, and the drive is connected to the rotator to drive the rotator to rotate so as to rotate the decoration;

wherein the drive comprises a motor and a first gear, the rotator is provided with a second gear, the second gear is fixedly connected to the rotator, and the motor drives the first gear to rotate in order to drive the second gear to rotate so as to drive the rotator to rotate;

wherein the rotator further comprises a mounting base and a transmission member, the decoration is mounted on the mounting base, the mounting base is fixedly connected to the transmission member, the second gear is fixedly connected to the transmission member, the second gear rotates to drive the transmission member to rotate, the transmission member rotates to drive the mounting base to rotate so as to drive the decoration to rotate;

wherein the mounting base is set opposite to the transmission member, the mounting base comprises a buckle, the transmission member is provided with a clamping opening at a position corresponding to the buckle, and the mounting base is clamped to the clamping opening of the transmission member by the buckle.

* * * * *